United States Patent [19]

Schmid et al.

[11] Patent Number: 4,565,498

[45] Date of Patent: Jan. 21, 1986

[54] ROTARY GAS COMPRESSOR

[75] Inventors: Norbert Schmid; Siegfried Schönwald, both of Bad Neustadt, Fed. Rep. of Germany

[73] Assignee: Siemens Aktiengesellschaft, Munich and Berlin, Fed. Rep. of Germany

[21] Appl. No.: 629,037

[22] Filed: Jul. 9, 1984

[30] Foreign Application Priority Data

Oct. 18, 1983 [DE] Fed. Rep. of Germany ..... 3337837

[51] Int. Cl.[4] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 1,180,613 | 4/1916 | Siemen | 417/68 |
| 1,418,040 | 3/1922 | Trane | 417/68 |
| 3,721,508 | 3/1973 | Mugele | 417/68 |
| 4,083,658 | 4/1978 | Ramm | 417/68 |

FOREIGN PATENT DOCUMENTS

| | | | |
|---|---|---|---|
| 284674 | 6/1914 | Fed. Rep. of Germany | 417/68 |
| 2064002 | 6/1981 | United Kingdom | 417/68 |
| 779643 | 11/1980 | U.S.S.R. | 417/68 |

*Primary Examiner*—Richard E. Gluck

*Attorney, Agent, or Firm*—F. W. Powers; J. L. James

[57] ABSTRACT

The invention discloses a rotary gas compressor for liquids which includes an impeller housing, an impeller rotatably mounted in the housing, a housing cover, a control disc arranged between the housing and the cover, and a suction intake and pressure outlet provided on the housing cover. Within the housing cover suction and pressure chambers are defined by a separating web arranged between the cover and the control disc. Into the suction chamber opens the suction intake provided on the housing cover; a suction slot provided in the control disc then provides communication with the impeller. The pressure outlet connection communicates with the pressure chamber, and a pressure slot provided in the control disc then also communicates with the impeller. One or more additional pressure aperatures are arranged in the control disc adjacent to the pressure slot, and resilient valve tongues cover all of the additional pressure apertures, except for one aperture to which a pressure relief pipe is connected. The pressure relief pipe communicates at one end with the non-valved additional aperture, and at its opposite end it communicates within the pressure region of the compressor with the gas to be supplied, at a level above the liquid ring. The pressure relief pipe allows gas and/or liquid to flow in either direction for pressure relief purposes.

2 Claims, 5 Drawing Figures

ROTARY GAS COMPRESSOR

BACKGROUND OF THE INVENTION

This invention relates to a rotary gas compressor which comprises an impeller housing, an impeller rotatably mounted in the housing, a housing cover, a control disc arranged between the housing and the cover, a suction intake, a pressure outlet, a suction slot arranged in the control disc to provide communication between the suction intake and the impeller, a pressure slot arranged in the control disc to provide communication between the impeller and the pressure outlet, and a pressure relief arrangement for supplying ballast gas to the compressor when required.

A compressor of this type is disclosed in German Pat. No. 284 674. In the pressure chamber of this compressor is a tube attached to an aperture provded in the control disc, through which with specific pressure ratios ballast gas can be introduced into the cells of the impeller so that at the pressure slot a pressure corresponding as far as possible to the atmospheric pressure is achieved. Since with a still low vaccum at the intake stack, the gas to be supplied reaches a pressure exceeding the atmospheric pressure substantially before reaching the pressure slot, part of the gas to be supplied and possibly even liquid would escape via the tube. Therefore, installed in the tube is an automatically operating non-return valve by means of which such an escape is prevented.

SUMMARY OF THE INVENTION

One of the objects of the present invention is to provide a rotary gas compressor for liquids in which a gas pressure relief pipe can be arranged without the necessity of providing a non-return valve which could otherwise represent an additional source of malfunctions.

According to the invention there is provided a rotary gas compressor comprising an impeller housing, an impeller rotatably mounted in the housing, a housing cover, a control disc arranged between the housing and the cover, a suction intake, a pressure outlet, a suction slot arranged in the control disc to provide communication between the suction intake and the impeller, a pressure slot arranged in the control disc to provide communication between the impeller and the pressure outlet, an additional aperture arranged in the control disc adjacent to the pressure slot, and a pressure relief pipe communicating at one end with the additional aperture and at its opposite end being communicable with the gas to be supplied.

Thus, in the case of excess pressure in the region of the additional aperture, gas and possibly even liquid also may be expelled into the compressor cycle via the pipe. If there is a low pressure in the region of the aperture, then gas may be extracted from the cycle and supplied to the compressor impeller as ballast gas. This is made possible by the appropriate arrangement of the free end of the relief pipe, without an active component (non-return valve) being necessary. In this way the aperture itself fulfills a dual function. For a specific operating state it is used as a pressure aperture and otherwise as a bypass aperture for introducing ballast gas.

A preferred embodiment which is structurally simple utilizes a housing cover provided with a recess which is constructed and arranged according to the operating position of the compressor so that during operation of the compressor a gas pocket is formed in the recess above the liquid level, and the relief pipe opens into the recess above the liquid level. Thus only a very short relief pipe can be arranged in the pressure chamber during actual production of the compressor so that no subsequent connection work is necessary at the insertion point of the compressor.

The relief pipe may be arranged to open in a pressure line attached to the pressure outlet or in a liquid separator connected on the outlet side to the compressor so that compressors that are already installed can be equipped subsequently with a relief pipe without any structural changes.

In rotary compressors with pressure aperatures (in addition to the pressure slot) that are additionally controlled by valves the possibility exists that if one valve is omitted the relief pipe may be connected to one of theses pressure apertures which lacks a valve. The connection of the relief pipe may be simplified by the fact that a nipple is inserted into the corresponding pressure aperture and the relief pipe is put into this nipple. The nipple can be safely secured, without separate securing parts being necessary, by supporting the nipple on a holding plate carrying resilient tongues which form the valves for the additional apertures.

Other features and advantages of the present invention will become apparent from the following detailed description, and from the claims.

For a full understanding of the present invention, reference should now be made to the following detailed description and to the accompanying drawings.

DETAILED DESCRIPTION

Figure 1:
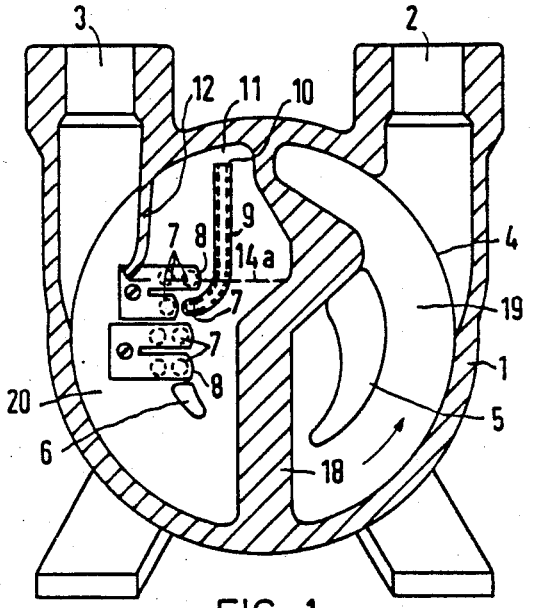
FIG. 1 is a schematic front view of a control disc side of an embodiment of the rotary compressor.

Referring now to FIG. 1, housing cover 1 has suction intake 2 and pressure connection 3 moulded in it. Inserted in housing cover 1 is control disc 4 which has suction slot 5 and pressure slot 6. With respect to the direction of rotation of the impeller (not shown) of the compressor there are provided in front of pressure slot 6 additional pressure apertures 7 which are covered by resilient tongues 8. These resilient tongues 8 form valves for these additional pressure apertures 7. The resilient tongues 8 are supported by holding plate 17 arranged over them (the plate not being shown in FIGS. 1 and 2 for greater clarity). Attached to one of the pressure apertures 7 is a hollow guide or relief pipe 9, which with its free end 10, opens into recess 11 provided in the housing cover (i.e. at a point inside the pressure region). Thus, recess 11 is arranged in pressure chamber 20 which is defined within housing cover 1 and is separated from suction chamber 19 by web 18.

Recess 11 is formed by extension 12 of one side wall of pressure connection 3. During operation of the compressor a gas pocket is formed in this recess 11 above the liquid level 14A. Thus with the corresponding operating relationships, by means of the relief pipe and corresponding pressure aperture 7 (not provided with a valve tongue 8), ballast gas can flow into the compressor chamber. Alternatively, if, with a specific operating state of the compressor in the region of corresponding pressure aperture 7, there is an excess pressure, then gas and possibly even liquid can be expelled via pressure aperture 7. The gas collects in recess 11 and the expelled liquid reaches the liquid present in the pressure chamber. Thus there is no necessity to close the relief pipe by means of a non-return valve.

Figure 2:
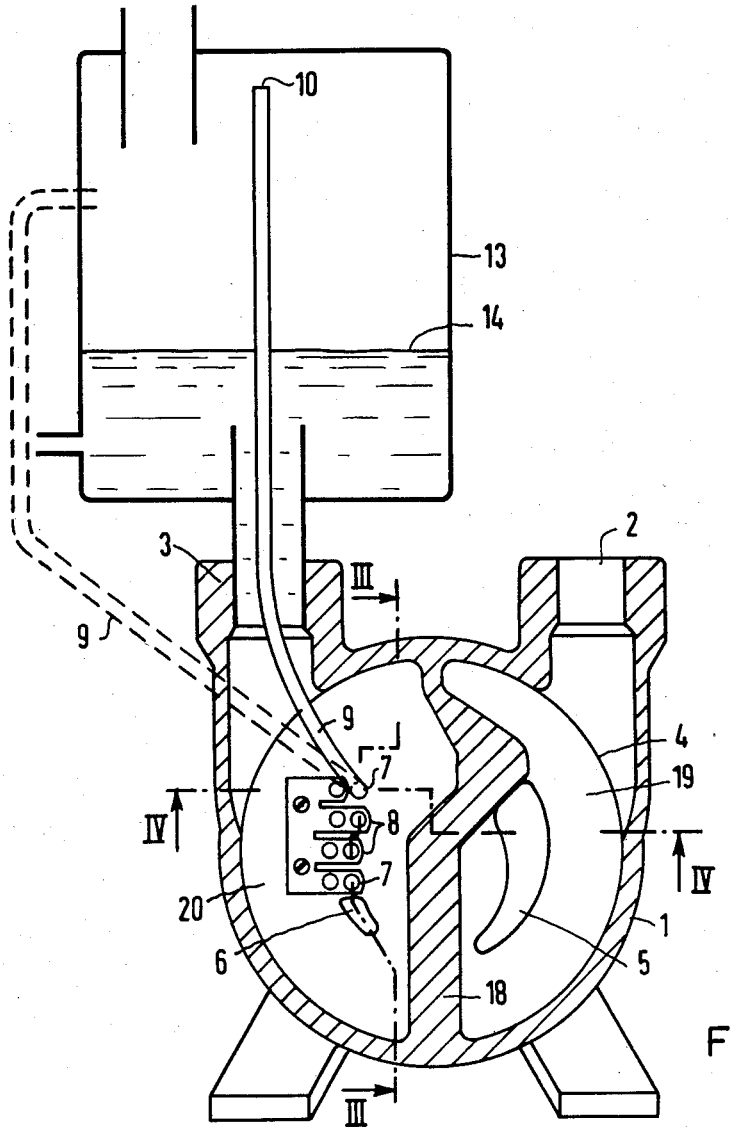
FIG. 2 is a view, similar to FIG. 1, of another embodiment having a liquid separator connected on the outlet side of the compressor.

The embodiment shown in FIG. 2 differs from that shown in FIG. 1 in that relief pipe 9 is guided into liquid separator 13 connected on the outlet side to the liquid rotary compressor. Free end 10 of the relief pipe is arranged above liquid level 14 so that with corresponding pressure ratios on the compressor, ballast gas can flow via relief pipe 9 into the compressor chamber. On the other hand, gas and possibly even liquid can be expelled via relief pipe 9 into liquid separator 13. Since the fitting of relief pipe 9 required no structural changes at all apart from possible shortening of resilient tongue 8 associated with corresponding pressure aperture 7, relief pipe 9 can be fitted at any time even in liquid ring type compressors that are already installed.

There is also the possibility of letting relief pipe 9 end in the pressure line leading to the liquid separator. This is possible if the pressure line is guided in a bend from above into the liquid separator, since at this point the chamber is filled with gas. There is also the possibility of shifting relief pipe 9 outside the pressure line and introducing it into liquid separator 13 from the outside. Such a movement of relief pipe 9 is indicated in FIG. 2 by dashed lines.

Figure 3:
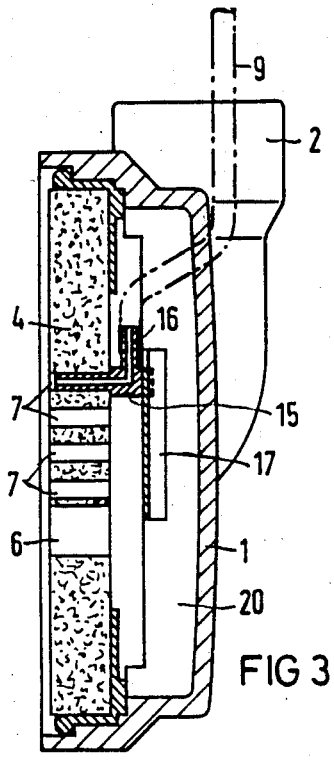
FIG. 3 is a sectional view, taken along line III—III in FIG. 2.
Figure 4:
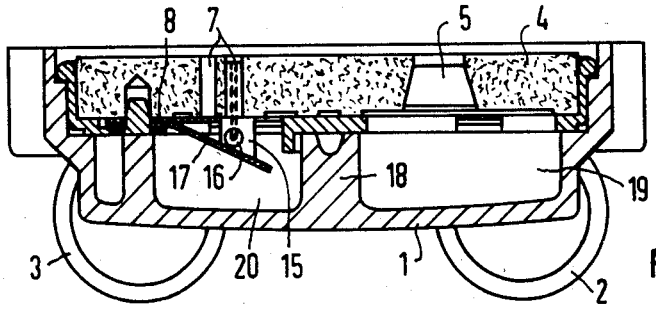
FIG. 4 is a sectional view taken along line IV—IV in FIG. 2.

The sectional view in FIGS. 3 and 4 show in particular one possibility of connecting relief pipe 9 to pressure aperture 7. Into corresponding pressure aperture 7 there is inserted a nipple 15 which has a pipe socket 16, onto which is put relief pipe 9. In order to manage without separate securing parts, nipple 15 is clamped below holding plate 17 which is provided for resilient tongues 8. Nipple 15 can thus not be pressed out of pressure aperture 7. Referring to FIG. 4 one can seen separating web 18 moulded with housing cover 1, through which web suction chamber 19 provided in the housing cover is separated from pressure chamber 20, which is also provided in the housing cover.

Figure 5:
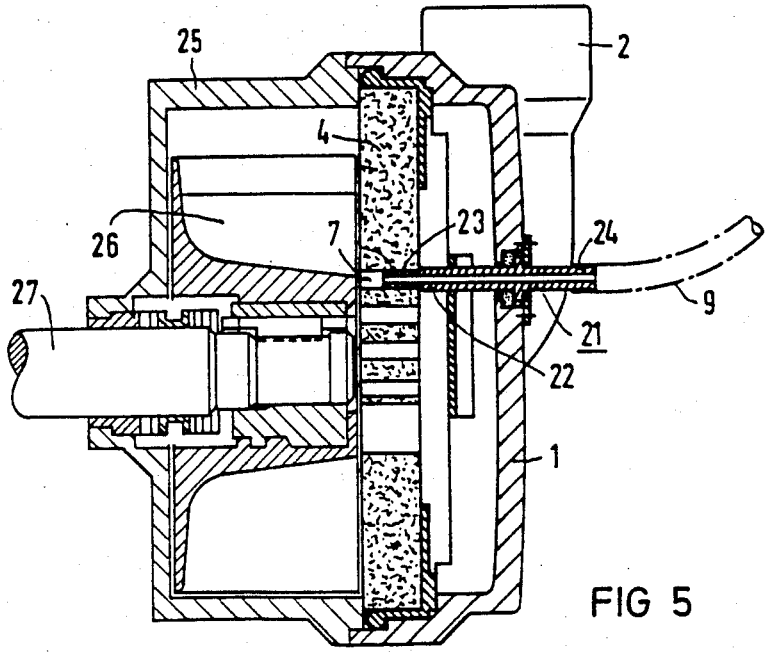
FIG. 5 is a view, similar to FIG. 3, of an alternative means for connecting a pressure relief pipe to the control disc of the compressor.

FIG. 5 shows another possibility for connecting relief pipe 9. Mounted on housing cover 1 is a bushing 21 which has on the inside of housing cover 1 an extension constructed as a pipe piece 22, the end of which is inserted into pressure aperture 7 of control disc 4. Onto end 24 of bushing 21, located on the outside of housing cover 1, relief pipe 9 is placed. From here relief pipe 9 is then guided to a point lying above the liquid level. Because of this external connection point for the relief pipe, the latter can be shifted in a simple manner outside the compressor and the pipe lines, which means a substantial simplification in assmelby particularly with a subsequent installation in an already existing design of rotary gas compressor. Also shown in FIG. 5 is the impeller housing 25 of the liquid ring pump in which the impeller 26 is rotatably arranged. Impeller 26 can be driven by a shaft 27 connected to a motor or similar device.

There has thus been shown and described a rotary gas compressor which fulfills all the objects and advantages sought therefor. Many changes, modifications, variations and other uses and applications of the subject invention will, however, become apparent to those skilled in the art after considering the specification and the accompanying drawings which disclose embodiments thereof. All such changes, modifications, variations and other uses and applications which do not depart from the spirit and scope of the invention are deemed to be covered by the invention which is limited only by the claims which follow.

What is claimed is:

1. A rotary liquid ring type gas compressor comprising:

an impeller housing; an impeller rotatably mounted in the housing; a housing cover; a control disc arranged between the housing and the cover; a suction intake; a pressure outlet; a suction slot arranged in the control disc to provide communication between the suction intake and the impeller; a pressure slot arranged in the control disc to provide communication between the impeller and the pressure outlet; an additional aperture arranged in the control disc adjacent to the pressure slot; a recess on the housing cover to define, in use, a gas pocket which is above the liquid level; and a pipe for supplying ballast gas to the compressor, said pipe communicating at one end with the additional aperture and the opposite end of the pipe opening into said recess at a position which in use is above the liquid level.

2. The compressor according to claim 1, further comprising a plurality of pressure apertures arranged adjacent to, but forwardly of the pressure slot with respect to the intended direction of rotation of the impeller, and valves cooperating with all of the pressure apertures except for one to which said pipe for supplying ballast gas is connected.

* * * * *